US005685349A

United States Patent [19]

Mihail et al.

[11] Patent Number: 5,685,349

[45] Date of Patent: Nov. 11, 1997

[54] BIASED PLUNGERS AND VENT BARS FOR AN APPARATUS FOR INTRODUCING FILLER MATERIAL INTO CONTAINERS

[75] Inventors: Stavros Mihail, Seattle; Marvin L. Berg, Tacoma, both of Wash.

[73] Assignee: Promation Incorporated, Seattle, Wash.

[21] Appl. No.: 473,021

[22] Filed: Jun. 6, 1995

[51] Int. Cl.[6] ..... B65B 1/04

[52] U.S. Cl. ..... 141/144; 141/71; 141/146; 141/259; 53/529

[58] Field of Search ..... 141/144, 145, 141/146, 147, 258, 259, 260, 71, 73, 80, 12; 53/529, 253, 320, 438, 439; 100/90

[56] References Cited

U.S. PATENT DOCUMENTS

| | | | |
|---|---|---|---|
| 113,326 | 4/1871 | Mueller | 53/320 |
| 1,667,991 | 9/1928 | Russell . | |
| 2,127,393 | 8/1938 | Doney . | |
| 2,462,840 | 3/1949 | Borg | 141/80 |
| 2,562,815 | 7/1951 | Oscroft . | |
| 2,564,969 | 8/1951 | Goldberg . | |
| 2,661,095 | 12/1953 | Koth . | |
| 2,939,407 | 6/1960 | Keathley, Sr. et al. . | |
| 3,186,140 | 6/1965 | Bogdanovich . | |
| 3,217,944 | 11/1965 | Bell et al. . | |
| 3,258,041 | 6/1966 | Lau . | |
| 3,513,626 | 5/1970 | Zhavoronkova et al. . | |
| 3,695,486 | 10/1972 | Warner . | |
| 3,780,490 | 12/1973 | Schack et al. . | |
| 3,820,194 | 6/1974 | Theisen . | |
| 3,864,891 | 2/1975 | Piereder . | |
| 4,068,008 | 1/1978 | Orchard . | |
| 4,373,560 | 2/1983 | Elsworth . | |
| 4,582,103 | 4/1986 | Piereder . | |
| 4,594,066 | 6/1986 | Graham | 53/529 |
| 4,789,016 | 12/1988 | Mihail . | |
| 4,893,660 | 1/1990 | Berg et al. . | |
| 4,961,446 | 10/1990 | Berg et al. . | |
| 5,012,957 | 5/1991 | Mihail . | |
| 5,240,049 | 8/1993 | Chiari | 141/71 |
| 5,285,828 | 2/1994 | Mihail et al. . | |

FOREIGN PATENT DOCUMENTS

| | | |
|---|---|---|
| 841292 | 7/1938 | France . |
| 61-166427 | 12/1986 | Japan . |
| 7348/61 | 2/1965 | Switzerland . |

*Primary Examiner*—Henry J. Recla
*Assistant Examiner*—Steven O. Douglas
*Attorney, Agent, or Firm*—Christensen O'Connor Johnson & Kindness PLLC

[57] ABSTRACT

Biased plungers and vent bars are used with an apparatus for introducing filler material into containers. The biased plungers and vent bars cooperate to vent gas that builds up below filler material as it is being introduced from a measuring chamber into an underlying container. In a preferred embodiment, the biased plungers and vent bars share a common elliptical path, which serves to define the relative vertical displacement of the individual elements. The vent bar precedes the filler material into the underlying container and provides a passageway for gas to escape the container as the filler material is introduced thereto.

8 Claims, 12 Drawing Sheets

BIASED PLUNGERS AND VENT BARS FOR AN APPARATUS FOR INTRODUCING FILLER MATERIAL INTO CONTAINERS

FIELD OF THE INVENTION

The present invention relates to plungers for introducing filler material into containers from a measuring cup, and to means for venting gas from the containers as the filler material is introduced therein. The present invention finds application in container filling systems, particularly those systems for introducing controlled volumes or uniform weights of filling material into containers, as described in U.S. Pat. Nos. 4,893,660; 4,961,446; 5,285,828; and 5,337,795, assigned to Promation Incorporated, the assignee of the subject application.

BACKGROUND OF THE INVENTION

High speed filling systems for introducing filler material from measuring chambers into containers for ultimate distribution to a consuming public are used in many industries. Such filling systems enable a processor to introduce filler material, such as butchered fish, having their heads, fins, and entrails removed, into cans that will be hermetically sealed prior to distribution to the public. Such filling systems are designed to introduce closely toleranced weights of filler material into the can in a manner that presents the filler material to the consumer in an attractive manner. One such system for introducing butchered salmon into cans has been developed by the inventors of the present invention and is described in U.S. Pat. Nos. 4,893,660; 5,285,828, and 5,337,795. A modification of that system for introducing filler material of an amorphous nature into containers is described in U.S. Pat. No. 4,961,446. Both of these systems developed by the present vendors operate at speeds on the order of 300 to 400 cans per minute. Unfortunately, taking full advantage of the speed of the such filling systems has not been possible for several reasons. For example, when such systems are operated at high speeds on the order of 300 to 400 cans per minute, the filler material must be rapidly introduced into the can. Since the filler material is introduced into the can in the form of a plug, gas present in the can prior to introduction of the filler material is trapped beneath the plug of filler material. If the gas does not escape the can as the filler material is introduced therein, the buildup of pressure in the void between the filler material and the can often results in ejection of the filler material from the can.

The build-up of gas within the can is particularly prevalent in larger cans, e.g., tall cans, such as one-pound salmon cans, because of the increased volume of gas in the can. To a lesser degree, the build-up of gas is a problem for short cans commonly known as one-half pound cans. Attempts have been made to address this problem of gas build-up by evacuating the can by heating and cooling the can just prior to introduction of the filler material. Unfortunately, such attempts to evacuate the can prior to introducing filler material have been less than effective at addressing the problem. The difficulties encountered from the inability to evacuate the gas from the container will become more prevalent as the speeds with which container filling systems operate increase. Accordingly, while prior systems described above in applicant's prior patents provide more desirable high-speed filling of containers compared to earlier systems, it has not been possible to take full advantage of their design capabilities. Accordingly, there continues to be a need for improvements to such high-speed filling systems, so that full advantage of their high-speed filling capacity and accuracy is achieved.

SUMMARY OF THE INVENTION

The present invention is an improvement in container filling systems such as those described in U.S. Pat. Nos. 4,893,660; 4,961,446; 5,285,828; and 5,337,795 to the inventors of the subject application. The improvement relates to plungers for introducing filler material into containers from measuring chambers and a system for venting gas from the containers as the filler material is introduced thereto. The plungers are designed to compress the filler material to a certain degree after it is introduced into the containers so that the filler material fills substantially the entire volume of the container below the lid of the container. The venting system is designed to vent gas from the containers as the filler material is being introduced therein under pressure.

The plunger system of the present invention finds application in container-filling systems that displace filler material from measuring chambers into containers, wherein each measuring chamber is carried by a platform mounted on a multi-sided ring that revolves substantially in unison around a primary axis with a container that is carried on an underlying plate or a platform during the dispensing cycle, the measuring chamber being positioned above the container along a second axis different from the primary axis. The plunger system formed in accordance with the present invention includes a generally circular track centered along the primary axis. This track lies in a non-horizontal plane above the multi-sided ring. A plunger tracking assembly is provided for following the track and is coupled to the plunger system that is carried by the multi-sided ring above the measuring chamber and container. The plunger system is designed to reciprocate vertically along the second axis to displace filler material from the measuring chamber into the underlying container. The plunger system includes a cylindrical-shaped plunger that carries a spring assembly for absorbing a portion of the vertical displacement of the plunger tracking assembly relative to the plunger as the plunger rotates around the primary axis and the guide follows the track, thus providing a damping action to the plunger.

The venting system formed in accordance with the present invention is useful with a container-filling system that displaces filler material from measuring chambers into containers, wherein each measuring chamber is carried by a platform that revolves around a primary axis substantially in unison with container positioned below the measuring chamber. During the dispensing cycle, the measuring chamber is positioned above the container along a second axis different from the primary axis. The platforms for the measuring chambers are carried by a multi-sided ring that rotates around the primary axis. In a preferred embodiment, the venting system, like the plunger system, cooperates with the plunger tracking assembly and track to provide vertical reciprocation to the venting system. The plunger tracking assembly follows the track and is coupled to a vent bar through the plunger system. Vertical displacement of the plunger tracking assembly as it follows the track is transferred to the vent bar, which causes the vent bar to reciprocate vertically. Along the downward stroke of reciprocation, the vent bar passes through the measuring chamber and into the container. During the upward stroke of reciprocation, the vent bar exits the container and out of the measuring chamber. The lower end of the vent bar includes a passageway to allow gas trapped below the filler material in the container to escape.

The present invention also relates to a method for displacing filler material from measuring chambers into containers, wherein each measuring chamber revolves substantially in unison with a container around a primary axis. The measuring chamber is positioned above the container along a second axis different from the primary axis. The measuring chambers are carried by platforms attached to a multi-sided ring that rotates around the primary axis. The containers can be likewise carried by platforms attached to the multi-sided ring or they can be supported by a continuous plate underlying the platforms for the measuring chambers. The method includes the steps of providing a passageway in the filler material while the filler material is in the measuring chamber. The passageway is maintained in the filler material as the filler material is introduced into the container. Gas trapped within the container below the filler material is vented through the formed passageway. The passageway is then removed after the gas is exhausted.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

While the preferred embodiment of the invention is illustrated and described, it will be appreciated that various changes can be made therein without departing from the spirit and scope of the present invention. For example, the following specification describes the illustrated embodiment which includes a container filling system for half-pound cans. It should be understood that the invention is equally applicable to container filling systems designed for other size containers, such as those commonly referred to as pound cans, that are roughly twice as large as the half-pound containers.

The present invention is an improvement to the container filling systems described in U.S. Pat. Nos. 4,893,660; 4,961,446; 5,285,828; and 5,337,795. The disclosures of the four above-identified U.S. patents are incorporated into the present specification by reference. The improvement of the present invention relates generally to the plunger system that introduces filler material from the measuring chambers into the containers and the venting system that provides a means for venting gas from the containers as the filler material is introduced therein. The material feed subsystem, measuring subsystem, transfer subsystem, synchronized drive subsystem, and container advance subsystem are substantially the same and operate in substantially the same manner as those same subsystems described in the four above-identified patents, particularly the systems described in U.S. Pat. Nos. 5,285,828 and 5,337,795.

One difference between the embodiment of the present invention described below and the subject matter described in the '446 patent for dispensing amorphous material relates to the orientation of the filler material when it is introduced into a measuring chamber. In the device of the '446 patent, the filler material is randomly oriented. In contrast, the embodiment of the present invention that is described below relates to filler material that is oriented in one direction for introduction into the measuring chambers and containers. The specific filler material that is described below is whole salmon. When whole salmon is introduced into a container in accordance with the present invention, a clean cross section of salmon is presented to the consumer. This clean cross section gives the impression to the consumer that the can contains a single chunk of salmon. Nonetheless, it should be understood that the plunger system and venting system formed in accordance with the present invention are not limited in application to non-amorphous filler material. For a full understanding of the supporting systems briefly noted above, reference is made to the disclosure of the four above-identified U.S. patents. A brief description of the operation of the individual subsystems is provided below.

Figure 1:
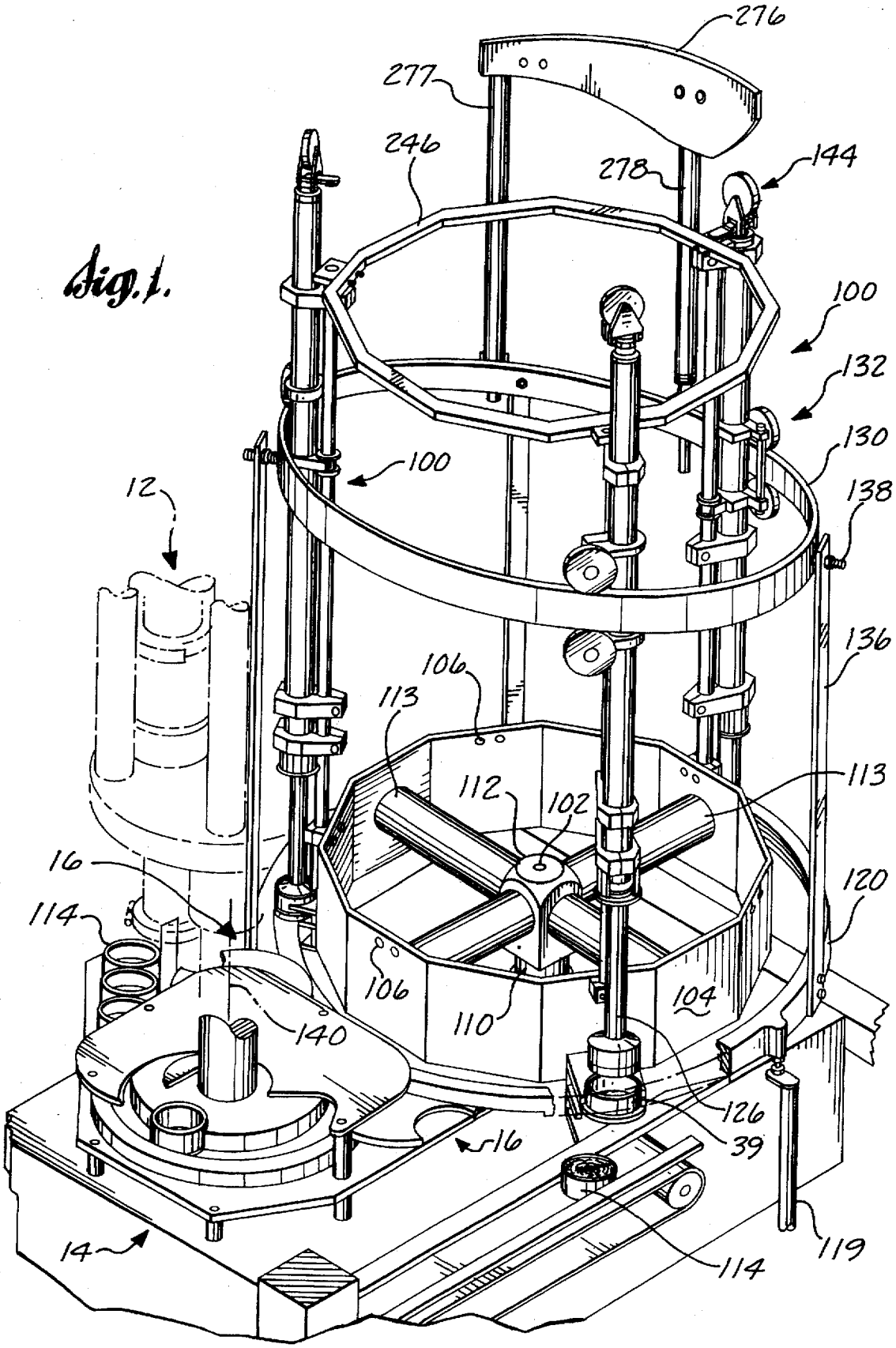
FIG. 1 is a schematic view of a container filling system that includes the plunger system and venting system formed in accordance with the present invention.

Briefly, referring to FIG. 1 of the present application, filler material is delivered to measuring subsystem 14 from material feed subsystem 12. Measuring subsystem 14 operates in a continuous rotational pattern around vertical axis 140 and produces portions of closely controlled weight and volume from the filler material supplied by material feed subsystem 12. These measured portions are contained within measuring chambers 39 which are then advanced from measuring subsystem 14 to transfer subsystem 16. Transfer subsystem 16 also operates in a rotational pattern and transfers measuring chambers 39 to plunger systems 100 formed in accordance with the present invention. Each plunger system 100 rotates about a vertical primary axis 102 different from axis 140 and dispenses the precisely controlled portions of filler material into a container 114 that is positioned directly beneath measuring chamber 39 and plunger system 100. As each plunger system 100 revolves around primary axis 102, it reciprocates in the vertical direction and forces filler material out of measuring chamber 39 into underlying container 114. As a given plunger system 100 nears completion of one revolution it moves upward out of measuring chamber 39. Container 114 is separated from plunger subsystem 100 and delivered to a further processing step separate from the container filling process and measuring chamber 39 is delivered by transfer subsystem 16 back to measuring subsystem 14 for refilling. To ensure that the various subsystems described above operate in synchronization, a common synchronized drive subsystem (not shown) is provided. For a more detailed description of each of the individual subsystems described above, reference is made to the disclosure of the patents noted above.

Continuing to refer to FIG. 1, plunger system 100 formed in accordance with the present invention is carried by ring 104, which in the illustrated embodiment includes 12 sides. In the embodiment illustrated in FIG. 1, ring 104 carries three plunger systems 100; however, it should be understood that when two measuring chambers 39 are filled per revolution of measuring subsystem 14, six plunger systems are preferred. In FIG. 1, three of the plunger systems have been omitted for purposes of clarity. Every other side or facet of ring 104 includes two bores 106 extending from one side of ring 104 to the other that receive bolts (not shown) for securing one end of a plunger system 100 to ring 104. Centered along primary axis 102 is a vertical shaft 110 that carries a hub 112 that preferably includes four arms 113, located approximately 90° apart and projecting radially from hub 112. The end of each arm 113 opposite hub 112 is secured to the inside surface of one side or facet of ring 104. As a result, ring 104 is rotatable in a horizontal plane around primary axis 102.

Figure 2:
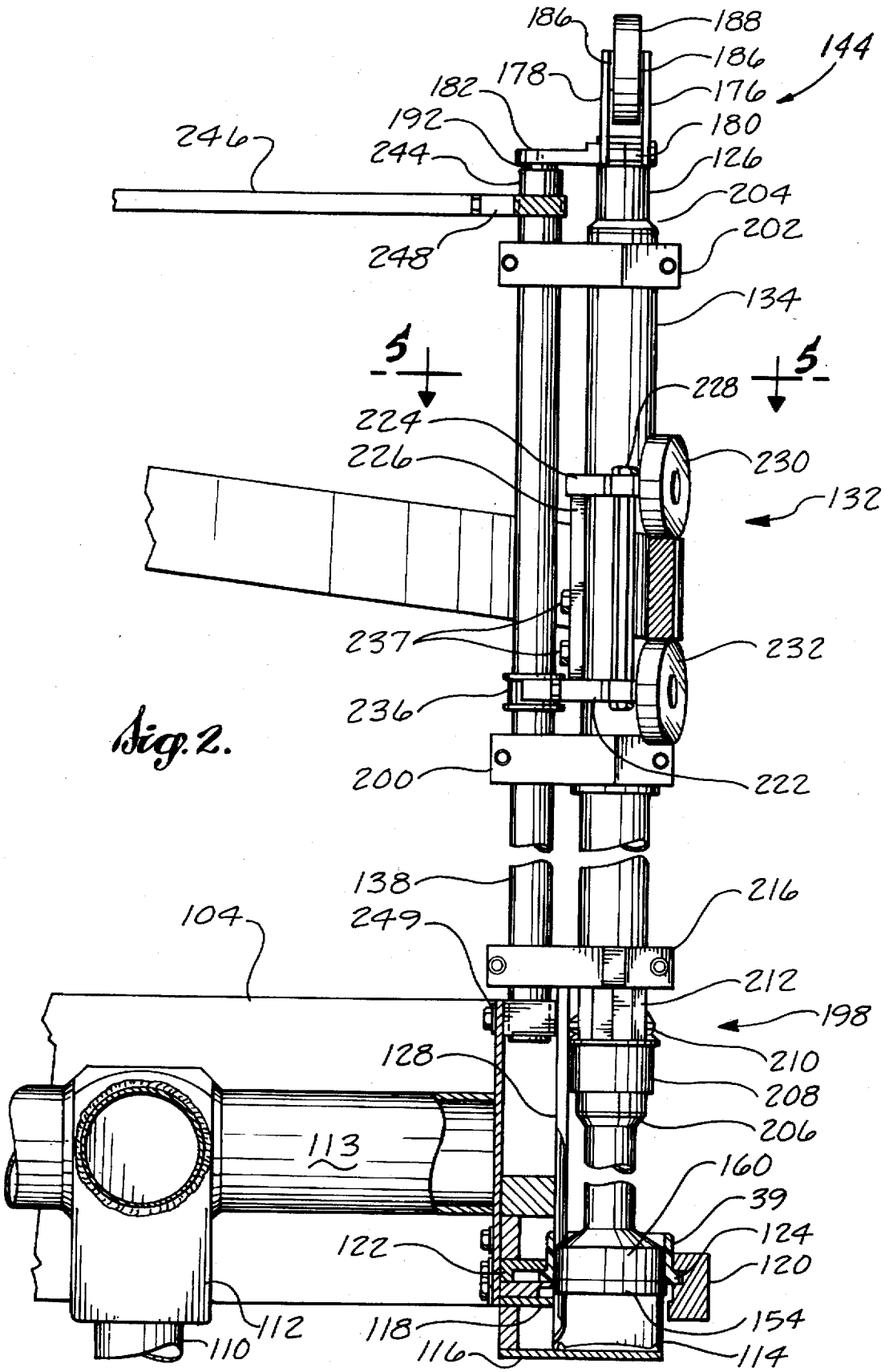
FIG. 2 is a front view with certain portions cut-away of one dispensing station that includes the plunger system and venting system formed in accordance with the present invention.

Referring additionally to FIG. 2, in addition to carrying plunger systems 100, in the embodiment illustrated in FIG. 1, ring 104 carries six horizontally disposed platforms 116, each for receiving and supporting a container 114. Horizontally disposed platforms 116 are similar to the platforms described in the noted patents. Each container 114 is further supported by a horizontal container receiving plate 118 that is spaced slightly above platform 116 and includes a semicircular recess for receiving and engaging a portion of the side of container 114 adjacent its upper open end. Each horizontally disposed platform 116 and horizontal container receiving plate 118 are secured to a side of ring 104 directly beneath a plunger system 100 so that container 114 is disposed directly beneath a plunger system 100. Concentrically disposed around ring 104 and supported by the surrounding framework (119 in FIG. 1) is a guide rail 120 that cooperates with platform 116 and plate 118 to retain container 114 on platform 116 as plunger system 100 rotates. Guide rail 120 overlaps the plane that the upper lip of container 114 lies in when positioned on platform 116. In this manner guide rail 120 restricts the radial movement of the container as the platform is revolving around primary axis 102. The manner in which container 114 is carried by platform 116 and plate 118 is substantially identical to the manner described in U.S. Pat. No. 4,961,446. In a preferred embodiment illustrated in FIG. 7 and described in more detail below, platforms 116 can be replaced with a continuous plate 123 suspended from the exterior surface of guide rail 120 below horizontal container receiving plates in such a manner that is does not interfere with the rotation of ring 104. When continuous plate 123 is employed, the containers slide along the upper surface of the plate as compared to the stationary position they assume on platforms 116 in FIGS. 1 and 2.

Figure 7:
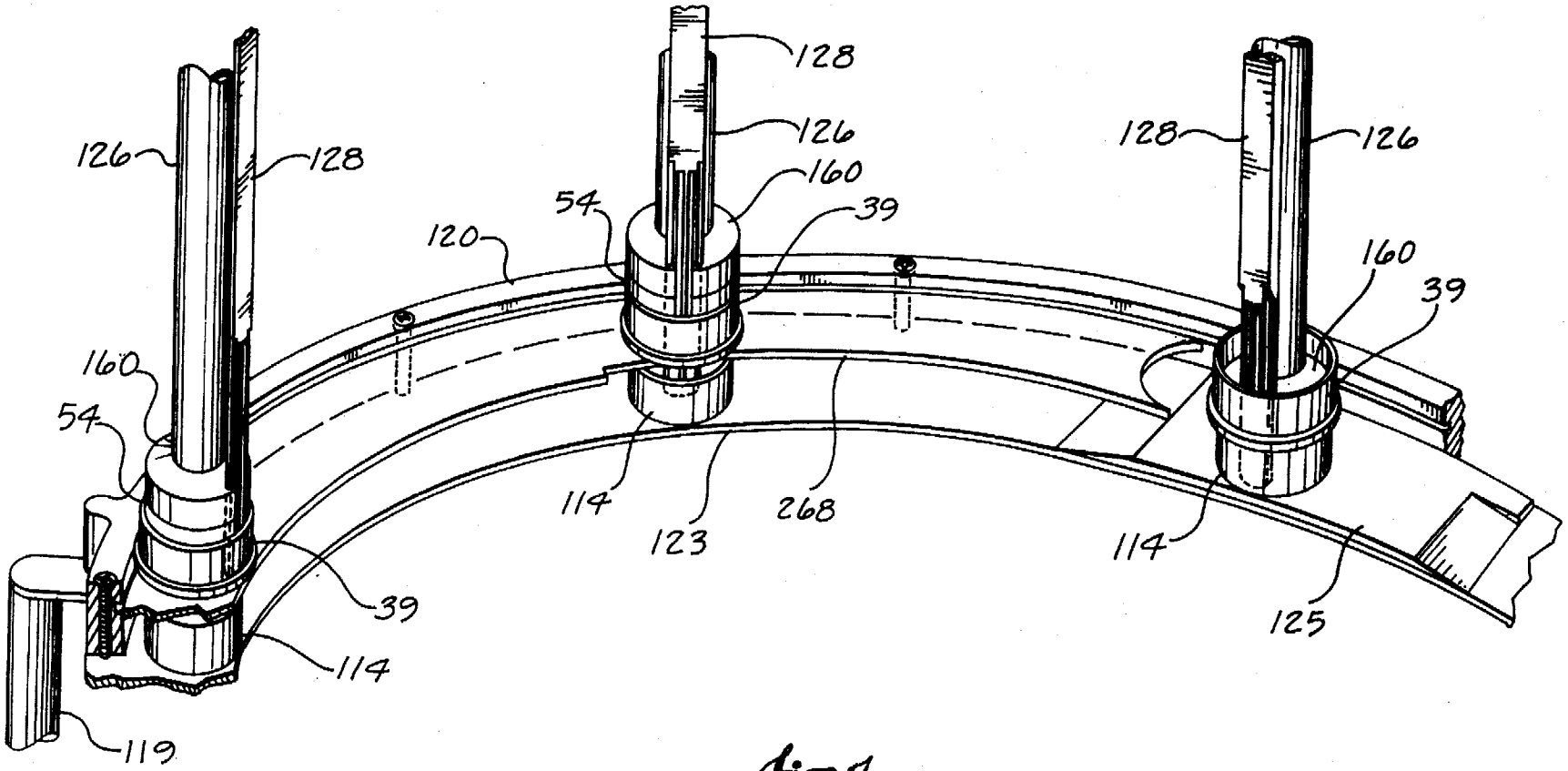
FIG. 7 is a schematic view of a support plate that maintains filler material within the measuring chambers prior to dispensing into the containers that are carried on a continuous plate with a riser in accordance with the present invention.

Referring to FIG. 7, continuous plate 123 is suspended below guide rail 120 by connectors, such as bolts, having one end secured to guide rail 120 and their opposite end secured to continuous plate 123. Continuous plate 123 begins at a point where containers 114 are transferred to the plunger system 100 and ends at the point where containers 114 exit the plunger system 100. Continuous plate 123 has a substantially flat upper surface with the exception of can riser plate 125. Can riser plate 125 is a plate or combination of plates that provide a ramp to raise the containers at the approximate time that the filler material begins to be introduced from the measuring chambers overhead. The height of the can riser plate 125 is chosen such that any gap between the top lip of container 114 and the lower edge of measuring container 39 is closed by the container being elevated and placed in closer proximity to the underside of the measuring container. In the instance of the illustrated embodiment a riser plate about 0.25 inches high provides the needed elevation.

Located above receiving plate 118 and platform 116 is a measuring chamber receiving plate 122. Measuring chamber receiving plate 122 is dimensioned to support the upper portion of measuring chamber 39 in a manner similar to the way container receiving plate 118 supports a container 114. Each measuring chamber receiving plate 122 is located above a corresponding container receiving plate 118 and includes a semicircular recess for receiving and engaging a portion of measuring chamber 39 above a radially extending boss 124 on the lower end of the measuring chamber. Measuring chamber receiving plate 122 below the recessed portion includes a slot for receiving boss 124. Guide rail 120 on its inner surface includes a groove for receiving boss 124 as measuring chamber 39 rotates around primary axis 102. The cooperation of the slot in measuring chamber receiving plate 122 and the groove in guide rail 120 serve to support and retain measuring chamber 39 in vertical alignment with container 114 as the entire assembly rotates about primary axis 102.

As briefly described above, plunger system 100 and vent system 108 formed in accordance with the present invention employ a track 130 that is centered along vertical axis 102. Track 130 is positioned directly above ring 104 and is held securely in place by support members 136. Support members 136 are elongate, rigid bars that include an upper end secured to track 130 and a lower end secured to the outer periphery of guide rail 120. The upper end of support members 136 is connected to track 130 by bolts 138. In the illustrated embodiment, four support members 136 are illustrated. It should be understood that additional support members 136 can be used in order to provide additional stability to track 130. Each of the four support members 136 are of a different length in order to account for the non-horizontal orientation caused by the undulation in track 130.

Figure 18:
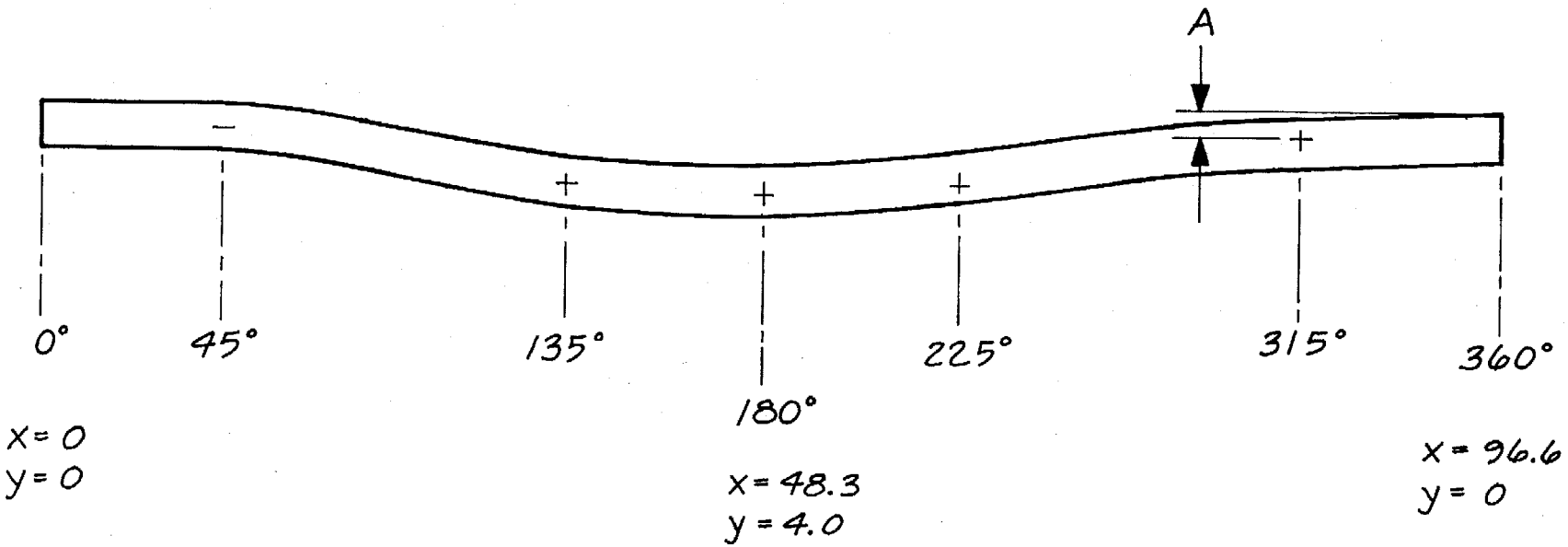
FIG. 18 is a side elevation view of a track formed in accordance with the present invention laid out in a horizontal plane.

Track 130 can be machined from an annular metal blank so that, when positioned above ring 104, the shadow or footprint cast on a horizontal plane directly below track 130 is circular. In the illustrated embodiment, the metal blank has an inner diameter of approximately 29.25 inches and an outer diameter of approximately 30.75 inches. The height of the blank is approximately 7.25 inches. Reference is made to FIG. 18, which illustrates a side elevational view of track 130 if it were unrolled onto a horizontal surface. The left-hand edge of the track defines $\theta=0°$, and the right-hand end of the track defines $\theta=360°$. At $\theta=0°$ and 360°, the y-coordinate is 0 and refers to the top surface of track 130. At $\theta=180°$, the y-coordinate is 4 inches. At $\theta=0°$, the x-coordinate is 0 inches. At $\theta=180°$, the x-coordinate is 48.3 inches, and at $\theta=360°$, the x-coordinate is 96.6 inches. At angles $\theta=45°$, 135°, 225°, and 315°, the distance A measured as the distance between the vertical center line of the track and the reference y=0 is set forth in the table below:

| Angle θ | A (inches) |
|---|---|
| 45 | 2.086 |
| 135 | 4.914 |
| 225 | 4.914 |
| 315 | 2.086 |

The resulting track 130 has a height measured from its upper surface to its lower surface at any point around its circumference of 3 inches. The outer diameter of the resulting track 130 is 30.75 inches and it is 0.75 inches thick. It should be understood that track 130 is illustrative of the many different sizes of tracks that may be applicable in accordance with the present invention, depending upon the amount of vertical reciprocation needed as well as the size of the path that the cans and measuring chambers rotate around.

For purposes of further discussion, the starting position or 0° position around track 130 is referenced to the line connecting primary axis 102 and vertical axis 140 through the center of measuring subsystem 16. Using this as the starting point of the circular path that plunger tracking assembly 132 follows, the high point of track 130 is positioned at the 0° reference point and the low point is positioned 180° from the 0° reference point. The rollers 230 and 232 are positioned 10° clockwise ahead of the plunger axis, and accordingly, the vertical displacement of the plunger system lags the rollers by 10°.

Figure 3:
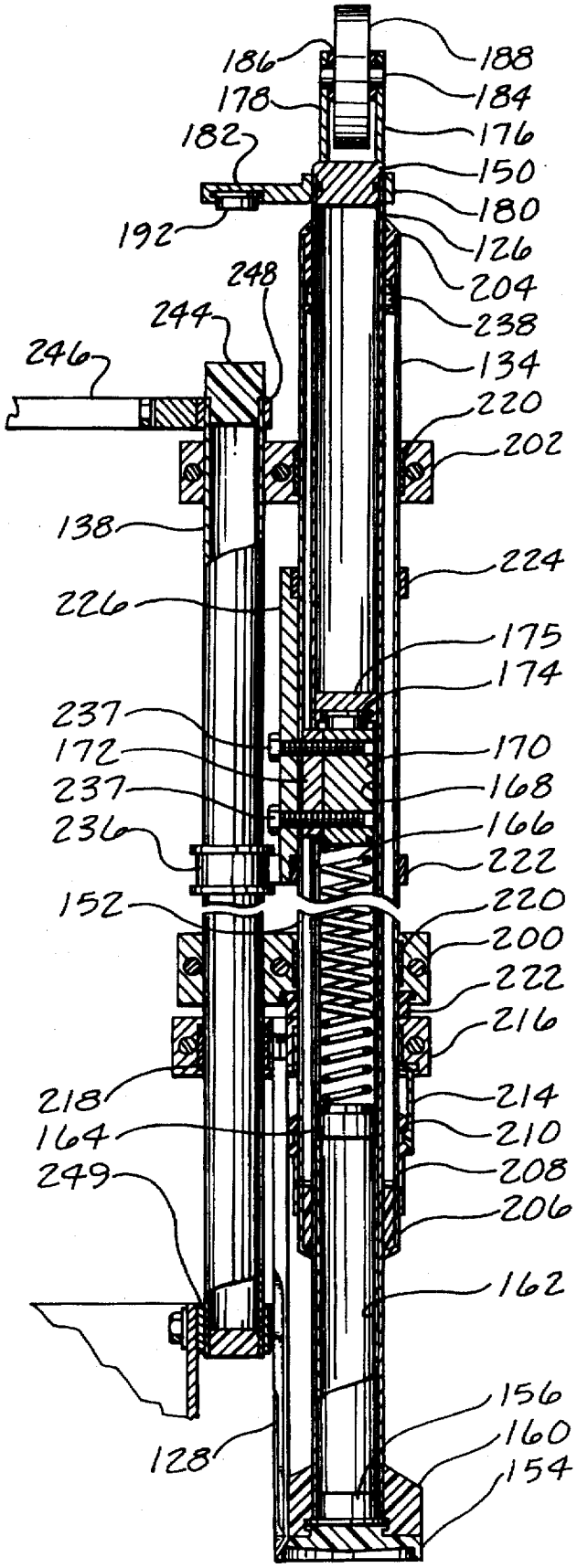
FIG. 3 is a front cut-away view of a portion of the plunger and venting system of FIG. 2.

Continuing to refer to FIG. 1, and additionally referring to FIG. 3, plunger system 100 is coupled to track 130 by plunger tracking assembly 132. Venting system 108 comprising vent bar 128 is connected to plunger system 100 through vent bar assembly 198 and is thus coupled indirectly to track 130. As plunger tracking assembly 132 follows the undulating path of track 130, it causes plunger 126 and vent bar 128 to reciprocate vertically.

Figure 4:
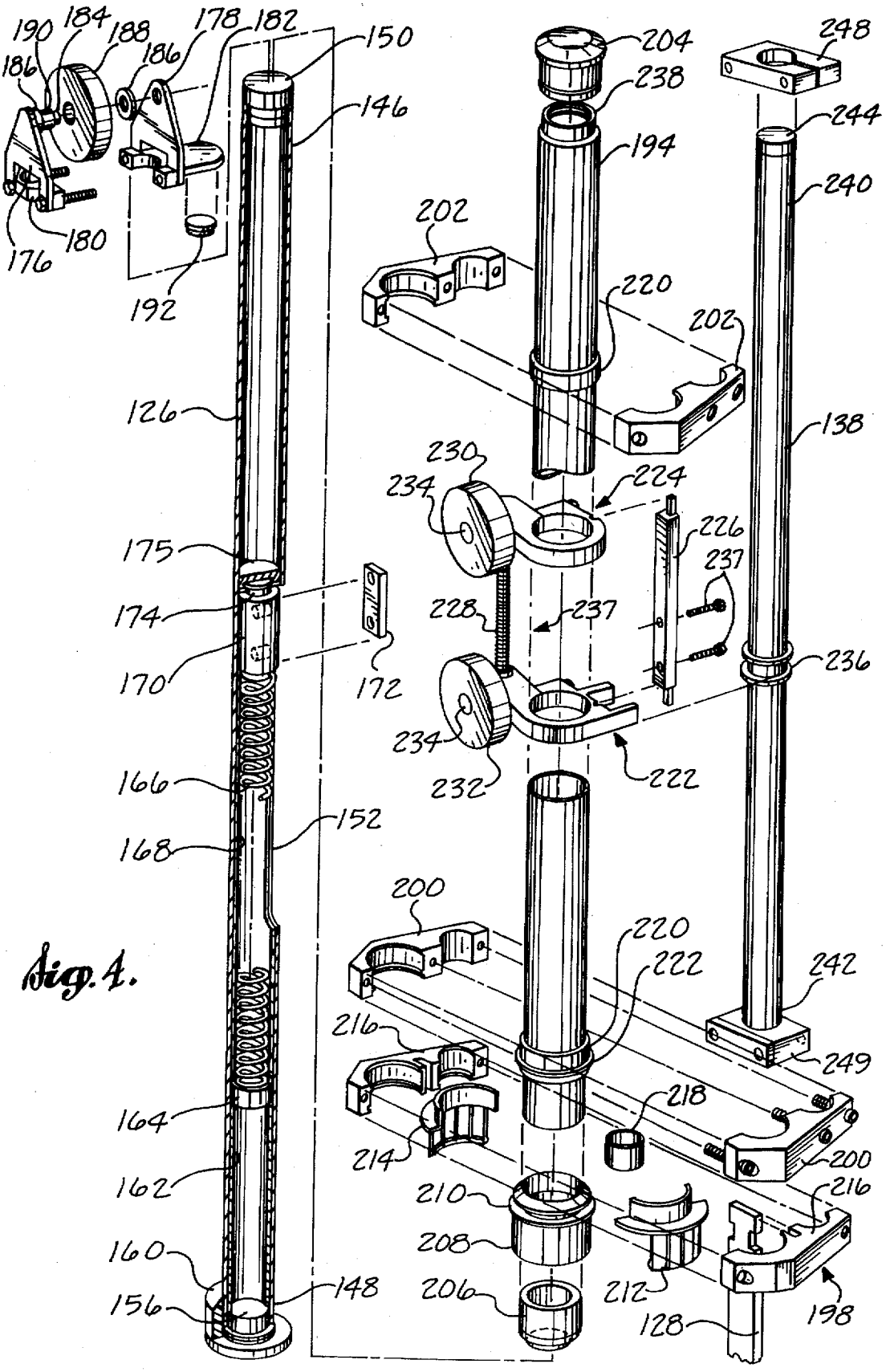
FIG. 4 is an exploded view of the plunger and venting system of FIG. 3 with a portion of the system cut-away.

Referring additionally to FIGS. 2, 3, and 4, plunger system 100 includes an elongate plunger 126, an annular, elongate plunger housing 134, elongate plunger guide 138, plunger tracking assembly 132, and biasing assembly 144. Each of these various assemblies of the plunger system 100 is described below in more detail. Plunger 126 is an elongate tube machined from a noncorrosive metal such as stainless steel having an upper end 146 and an opposing lower end 148. In the illustrated embodiment, plunger 126 is about 32.75 inches long, has an inner diameter of about 1.375 inches, and an outer diameter of 1.5 inches. Upper end 146 is sealed by a plastic cap 150 that includes a lower portion having an outer diameter that allows it to fit snugly within upper end 146. Above the portion of cap 150 snugly secured within upper end 146 is the body of the cap, which has an outer diameter substantially equal to the outer diameter of plunger 126. Intermediate upper end 146 and lower end 148 is a guideway 152 that passes through the wall of plunger 126. In the illustrated embodiment, guideway 152 is oval in shape, having a major axis of about 6.25 inches parallel to the length of plunger 126, and a minor axis of about 0.625 inches. In the illustrated embodiment, the upper foci is approximately 11.875 inches from upper end 146.

Lower end 148 carries a plunger pad 154, plunger end 156, and vent bar guide 160. Plunger end 156 is machined from a plastic material, such as DELRIN®, and includes a cylindrical body portion having an outer diameter that enables it to fit snugly within lower end 148 of plunger 126. The lowermost portion of plunger end 156 includes a thin, round cap having an outer diameter about 0.25 inches greater than the outer diameter of plunger 126. The body portion of plunger end 156 can be secured within lower end 148 mechanically using, for example, a plurality of pins. Positioned directly below plunger end 156 is plunger pad 154 that is a generally circular, solid member having regions of three different diameters. The uppermost region has an outer diameter substantially equal to the outer diameter of the cap portion of plunger end 156. The length of this portion is approximately 0.125 inches in the illustrated embodiment. The outer diameter of plunger pad 154 below this upper portion decreases to about 1.5 inches for approximately another 0.125 inches and defines a peripheral notch in plunger pad 154. Outer diameter of plunger pad 154 then increases to a diameter of approximately 3.125 inches for about 0.5 inches. The underside of this lowermost portion of plunger pad 154 is recessed slightly in the form of a flattened inverted W. In the embodiment illustrated in FIG. 4, the right-hand edge of the lower portion of plunger pad 154 includes a guideway 158 for vent bar 128, as described below in more detail.

Surrounding the upper portion of plunger pad 154 and the lowermost portion of plunger end 156 is vent bar guide 160. Vent bar guide 160 is a generally annular element whose inner surface is machined to fit snugly around lower end 148, the cap portion of plunger end 156 and the peripheral notch in plunger pad 154. This cooperation serves to anchor vent bar guide 160 to the bottom of plunger 126. Vent bar guide 160 can be of a two-piece construction so that it can be sandwiched around lower end 148 and then secured thereto using compression screws. The right-hand side of vent bar guide 160 includes a machined recess to receive vent bar 128, as described below in more detail. As with plunger end 156, plunger pad 154 and vent bar guide 160 can be machined from plastic materials, such as DELRIN®.

Located within plunger 126 directly above the body portion of plunger end 156 is an annular spacer 162 formed from a plastic material, such as an acrylic. Spacer 162 has an outer diameter slightly less than the inner diameter of plunger 126 and extends upward approximately one-fifth of the overall length of plunger 126. In the illustrated embodiment, spacer 162 is approximately 7.7 inches long. Positioned so that it rests on the upper end of spacer 162 is a lower spring stop 164 machined from a plastic, such as DELRIN®, having a lower main portion having an outer diameter such that it slidably fits within plunger 126, yet cannot slide within spacer 162. Accordingly, spacer 162 serves as a lower stop for lower spring stop 164. Extending upwardly from the main portion of lower spring stop 164 is a portion of smaller diameter sized to fit within the helix of spring 164, described below in more detail.

Positioned above lower spring stop 164 is spring 166. Spring 166 is a coil spring having a compressive force ranging from about 10 to 15 pounds. Spring 166 has an outer diameter such that it fits within extruded TEFLON® sleeve 168, that is located above lower spring stop and extends upward to just below the upper end of guideway 152. Sleeve 168 has an outer diameter that is substantially equal to the inner diameter of plunger 126 and includes a slot substantially identical to guideway 152. Sleeve 168 is positioned within plunger 126 such that the slot is positioned so that it mates with guideway 152 and provides access to the interior of sleeve 168. Positioned above spring 166 is piston 170 having an outer dimension that allows it to slide within sleeve 168 and not protrude from the slot in sleeve 168 or the guideway 152 in plunger 126. Piston 170 includes two horizontal threaded bores for receiving bolts (not shown) for securing piston mount 172 to piston 170. Piston mount 172 is a flat, rectangular plate dimensioned to slide freely within guideway 152 and includes two bores that substantially coincide with the threaded bores in piston 170. Piston mount 172 includes an inner surface that mates with the portion of piston 170 exposed through the slot in sleeve 168 and guideway 152. The surface of piston mount 172 opposite the surface that is placed adjacent to piston 170 is convex. The piston mount has a length that is substantially equal to the length of the piston and has a width which allows it to freely slide within guideway 152. Piston 170 and piston mount 172 can be machined from a plastic material such as DELRIN®.

Spring 166 below piston 170 biases the piston upward within plunger 126. The upward bias of piston 170 is restricted by bumper 174 machined from a resilient material, such as neoprene, that is fixed by bumper mount 175 located within plunger 126 just above the top of guideway 152. In the illustrated embodiment, bumper 174 includes two portions, the lower portion having a smaller diameter than the upper portion. The upper portion of bumper 174 is received within a recess within bumper mount 175 that is machined from a plastic, such as DELRIN®, and secured in place to plunger using, for example, pins.

Through the cooperation of piston 170 sliding within sleeve 168 and piston mount 172 sliding within guideway 152, spring 166 can be compressed against lower spring stop 174. This movement allows plunger 126 to absorb a certain amount of vertical displacement of plunger housing 134, as described below in more detail.

Secured to upper end 146 of plunger 126 is biasing assembly 144 that includes left plate 176 and right plate 178, clamp 180, stop plate 182, shaft 184, and thrust bearings 186. Left plate 176 and right plate 178 are substantially mirror images of each other. Accordingly, the following description is equally applicable to both plates. Each plate is generally triangular in shape and includes a cavity at its apex that extends into the respective plate, but not completely through. The cavity is sized to snugly receive shaft 184 and support it between left plate 176 and right plate 178. The bottom of the triangular shaped plates opposite the cavity includes a rectangular cutout portion that serves to define left and right legs at the lowermost left and right apexes of the triangular plates. A smooth bore passes through each leg of left plate 176. In the right plate 178, threaded bores pass through each of the left and right legs. The plates can be machined from corrosion-resistant materials, such as stainless steel. In the illustrated embodiment, each plate is approximately 3 inches high and 2.75 inches wide, having a thickness of about 0.375 inches. The rectangular cutout portion is approximately 1.5 inches wide, and 0.875 inches high. As discussed above, shaft 184 is supported between the upper ends of left plate 176 and right plate 178 and carries biasing roller 188. Shaft 184 carries a plastic bearing 190 that has an inner diameter that allows bearing 190 to fit snugly on shaft 184 and an outer diameter that cooperates with a bore passing through biasing roller 188, as described below in more detail. Bearing 190 can be machined from a low-friction plastic, such as RULON®. Bearing 190 is spaced apart from the inner surface of left plate 176 and right plate 178 by thrust bearings 186. Thrust bearings 186 are in the form of a washer machined from a corrosion-resistant metal, such as stainless steel. Thrust bearings 186 are machined so that they fit snugly over shaft 184. In the illustrated embodiment, the bore passing through thrust bearings 186 is approximately 0.5 inches in diameter and thrust bearing has an outer diameter of approximately 1.0 inch.

Biasing roller 188 is machined from a high strength plastic material, such as TORLON®. Biasing roller 188 includes a bore passing through its horizontal axis having a diameter that allows biasing roller to roll freely around bearing 190. The outer diameter of biasing roller 188 in the illustrated embodiment is approximately 3 inches. Biasing roller 188 is designed to ultimately cooperate with top cam (276 in FIG. 1), as described below in more detail. Left plate 176 and right plate 178 are secured to upper end 146 of plunger 126 by clamp 180 and stop plate 182. Both clamp 180 and stop plate 182 include bores that cooperate with the smooth bores in left plate 176 and the threaded bores in right plate 178 to receive bolts that secure left plate to right plate, and thus tighten clamp 180 and stop plate 182 around upper end 146. Extending from the side of stop plate 182 opposite the side attached to upper end 146 is a semicircular plate that carries a neoprene bumper 192 on its underside.

Bumper 192 serves to cushion any contact by stop plate 182 with cap 244 in the top of plunger guide 138.

As described below, plunger 126 is carried within plunger housing 134 in a concentric arrangement and in a manner that allows plunger 126 to reciprocate vertically over a limited range relative to plunger housing 134. Plunger housing 134 is an elongate tubular element having an upper end 194 and an opposite lower end 196. Positioned near the lower end 196 is a vent bar assembly 198 for securing vent bar 128 to plunger housing 134. Spaced above vent bar assembly 198 is a lower bearing clamp 200 that slidably secures plunger housing 134 to plunger guide 138, as described below in more detail. Secured to plunger housing 134 above lower bearing clamp 200 is plunger tracking assembly 132 that slidably secures plunger 126 to plunger housing 134 and carries rollers for cooperating with track 130, as described below in more detail. Spaced above plunger tracking assembly 132 and below upper end 194 is an upper bearing clamp 202 for slidably securing plunger housing 134 to plunger guide 138, as described below in more detail. The open upper end 194 of plunger housing 134 carries bearing 204. These various assemblies attached to plunger housing 134 will be described below in more detail.

In the illustrated embodiment, plunger housing 134 has a substantially uniform outer diameter of approximately 2.0 inches and a length of approximately 25.625 inches. The inner surface of tubular plunger housing 134 includes three regions of differing diameters. In the illustrated embodiment, the majority of the inner surface of plunger housing 134 has a diameter of approximately 1.83 inches; however, the inner surface at lower end 196 has a region of greater diameter of approximately 1.875 inches, which extends upward in the illustrated embodiment approximately 1.375 inches. Plunger housing 134 at upper end 194 also includes a portion on its inner surface that includes a diameter of about 1.875 inches, which extends downward from upper end 194 approximately 1.25 inches. Below this portion, the diameter of the inner surface increases again to approximately 1.9 inches, for a distance of about 0.375 inches. This portion, which defines the largest diameter for the inner surface of plunger housing 134 is the region that receives a seal and O-ring to seal the top of plunger housing 134.

Seated within lower end 196 is bearing seal 206. Bearing seal 206 is a generally annular element machined from a plastic such as DELRIN® having an outer diameter that substantially mates with the inner diameter of lower end 196. The bottom-most portion of bearing seal 206 increases in diameter for a short portion to a diameter substantially equal to the outer diameter of plunger housing 134. Bearing seal 206 includes a bore passing through its center that has dimensions which allow it to slidably engage the outer surface of plunger 126 when plunger 126 is positioned within plunger housing 134. The lowermost end of bearing seal 206 includes a beveled edge that serves as a sharp-edged scraper. The bore measured from the points of the beveled edge substantially matches the outer diameter of the plunger 126 so that the sharp-edged scraper serves to remove unwanted material from the surface of plunger 126 as it reciprocates within plunger housing 134. Although not shown, bearing seal 206 is secured to plunger housing by mechanical means, such as pins.

Located above bearing seal 206 around plunger housing 134 is strike 208 that is a generally annular tube having a lower end that overlaps the portion of plunger housing 134 that surrounds the upper end of bearing seal 206, and an upper end that includes a seat 210 for cooperating with bearing fingers 212 of bearing latch 214, as described below in more detail. The surface of the inner bore passing through strike 208 has a diameter substantially equal to the outer diameter of plunger housing 134. Seat 210 on strike 208 is adjacent to the upper edge of strike 208 and includes a channel that extends around the perimeter of strike 208. Like bearing seal 206, strike 208 is secured to plunger housing by mechanical means, such as pins. In the illustrated embodiment, strike 208 is approximately 2.25 inches long. The upper end of strike 208 carries a beveled surface that leads into seat 210. The side of strike 208 adjacent vent bar 128 is partially cut away to provide for the reciprocation of vent bar 128.

Positioned above strike 208 around plunger housing 134 is bearing latch 214, which includes a plurality of downwardly extending bearing fingers 212. In the illustrated embodiment, bearing latch 214 is formed from two mirror-image halves that each carry four bearing fingers. The bearing fingers 212 extend downward from an annular body of each half of the bearing latch and terminate in inward protruding latches that are dimensioned to fit snugly within seat 210. A portion of the lowermost end of each finger is beveled upward so that it can cooperate with the beveled edge leading into seat 210. The annular body of bearing latch 214 includes a bore passing through its center, which has dimensions that cooperate with the outer diameter of plunger housing 134, allowing bearing latch 214 to be secured around plunger housing 134 by vent bar assembly 198, which comprises a vent bar mount 216 that includes halves that mate with each other to form a clamp around bearing latch 214, plunger housing 134, vent bar 128, and plunger guide 138. Strike 208 and bearing latch 214 can be machined from a plastic material, such as DELRIN®. Each half of bearing latch 214 at its side adjacent vent bar 128 has a portion cutaway to allow for the passage of the vent bar 128.

Vent bar mount 216 is a two-piece clamp that includes mating bores dimensioned to receive the bearing latch halves 214 and secure them around plunger housing 134. The portion of vent bar mount 216 that receives bearing latch 214 adjacent bearing fingers 212 has a diameter that is less than the diameter defined by the outer surface of bearing fingers 212 in a relaxed state. Accordingly, when bearing latch 214 is secured in vent bar mount 216 around plunger housing 134, bearing fingers 212 are biased inwardly by the pressure exerted by vent bar mount 216. This inward bias can be overcome by pushing the angled surfaces at the ends of the bearing fingers against the angled surface adjacent seat 210 to allow the tips of bearing fingers 212 to enter and become lodged within seat 210. Vent bar mount 216 includes a smaller bore for receiving bearing 218 and plunger guide 138 as described below in more detail. Each half of vent bar mount 216 is held in place by bolts (not shown). With respect to a bearing for the portion of vent bar mount 216 around plunger housing 134, the upper portion of bearing latch 214 serves as such a bearing. Positioned between the bore for receiving plunger housing 134 and the bore for receiving plunger guide 138 is a vertical extending rectangular slot for receiving and securing the upper end of vent bar 128 adjacent plunger housing 134. Thus, through vent bar mount 216, vent bar 128 is secured to plunger housing 134 by the cooperation of bearing fingers 212 and seat 210, but such connection is reversible should operation conditions result which prevent vent bar 128 from reciprocating downward when the system requires such. If the downward movement of vent bar 128 is restricted, yet plunger housing 134 continues to move downward, the pressure will cause bearing fingers 212 to release seat 210, and thus allow plunger housing 134 to continue its downward stroke, while vent bar 128 remains stationary.

Located above vent bar mount 216 is lower bearing clamp 200, which includes two substantially mirror-image halves, each including a portion of two bores. The larger of the two bores is dimensioned to receive a bearing 220 for slidably receiving plunger housing 134 and the top of a neoprene bumper 222 positioned around plunger housing above bearing 220. Neoprene bumper 222 is present to cushion any contact between the underside of lower bearing clamp 200 and the upper surface of vent bar mount 216. The smaller of the two bores in lower bearing clamp 200 does not include a bearing and is fixedly secured to plunger guide 138.

Adjacent the upper end 194 of plunger housing 134 is an upper bearing clamp 202, which is substantially identical to lower bearing clamp 220, with the exception that the larger bore does not include a seat for receiving neoprene bumper 222. In this manner, upper bearing clamp 202 and lower bearing clamp 200 are fixedly secured to plunger guide 138, which, as described below in more detail, is rigidly secured to other elements of the filling apparatus. Thus, plunger housing 134 is able to reciprocate vertically relative to plunger guide 138 and upper bearing clamp 202 and lower bearing clamp 200.

The reciprocation of plunger housing 134 is provided by plunger tracking assembly 132, which includes lower clamp 222, upper clamp 224, clamp bar 226, spacer 228, upper roller 230, and lower roller 232. Plunger tracking assembly 132 serves to secure piston 170 and piston mount 172 to plunger housing 134 so that piston 170 and piston mount 172 reciprocate in unison with plunger housing 134. In addition, plunger tracking assembly 132 provides rollers 230 and 232, which follow track 130, thus providing the vertical reciprocation to plunger housing 134. Lower clamp 222 is a compression clamp that includes a bore having dimensions for receiving plunger housing 134 and then securely attaching lower clamp thereto. In the illustrated embodiment, the left-hand side of lower clamp 222 includes a bore for receiving shaft 234 that carries lower roller 232. Shaft 234 is secured to lower clamp 222 using a clamping screw and a redundant retention ring (not shown), and has dimensions such that it rotatably carries lower roller 232. Lower roller 232 is machined from a plastic, such as DELRIN®, and in the illustrated embodiment has an outer diameter of approximately 3 inches. Upper roller 230 is identical to lower roller 232, and is attached to the left-hand end of upper clamp 224 in a similar fashion. Upper clamp 224, like lower clamp 222, is also a compression clamp having a bore for receiving plunger housing 134 and securely fastening upper clamp 224 thereto. Adjacent upper roller 230 and lower roller 232, upper clamp 224 and lower clamp 222 include a vertical bore for receiving the ends of an elongate spacer 228. Spacer 228 serves to add additional support and spacing between upper clamp 224 and lower clamp 222. Spacer 228 is secured to upper clamp 224 and lower clamp 222 by bolts positioned above and below the respective clamps. The right-hand edge of upper clamp 224 and lower clamp 222 each include a detent for receiving the ends of a clamp bar 226, described below in more detail. Extending from the right-hand edge of lower clamp 222 are two spaced-apart fingers for engaging a plastic annular sleeve 236 carried on plunger guide 138. Sleeve 236 includes upper and lower perimeter rails for engaging the fingers of lower clamp 222.

Clamp bar 226 intermediate the detents received by upper clamp 224 and 222 includes an elongate rectangular bar having two horizontal bores passing from the left-hand side to the right-hand side of the clamp bar. Each bore receives a bolt 237, which then passes through mating bolt holes in plunger housing 134, piston mount 172, and into the threaded bores in piston 170. Tightening of bolts 237 secures the detents on each end of clamp bar 226 into the slots in upper clamp 224 and lower clamp 222 and serves to securely attach plunger housing 134 to piston 170.

Upper end 194 of plunger housing 134 is closed by bearing 204. Bearing 204 is similar in structure to bearing seal 206 and includes the added structure of a detent near its lower end for receiving an O-ring for sealing bearing 204 to the inner surface of plunger housing 134. The inner surface defined by the bore passing through bearing 204 includes a further detent for receiving a seal for sealing bearing 204 to plunger 126. An annular seal ring 238 is provided to retain the inner seal in place.

Plunger guide 138 includes an upper end 240 and a lower end 242. Plunger guide 138 is an annular tube machined from a corrosion-resistant material, such as stainless steel. In the illustrated embodiment, plunger guide 138 is approximately 24.5 inches long and has an approximate outer diameter of about 1.25 inches. The open upper end 240 and open lower end 242 are sealed by DELRIN® caps 244. Upper end 240 is secured to 12-sided top ring 246 by upper guide clamp 248. Top ring 246 has an outer periphery identical to the periphery of multi-sided ring 104 and an inner periphery substantially identical to the inner periphery of multi-sided ring 104; however, top ring 246 is only about 0.5 inches high, and is slightly thicker than multi-sided ring 104. Upper clamp 248 is secured to top ring 246 by bolts or other mechanical means and includes a compression fitting for securely attaching to upper end 240. Lower end 242 is secured to multi-sided ring 104 in a similar fashion and includes a similar compression fitting for securely receiving lower end 242. Thus, plunger guide 138 does not reciprocate and serves as a stationary guide supporting the reciprocation of plunger housing 134 and reciprocation of plunger 126.

Figure 15:
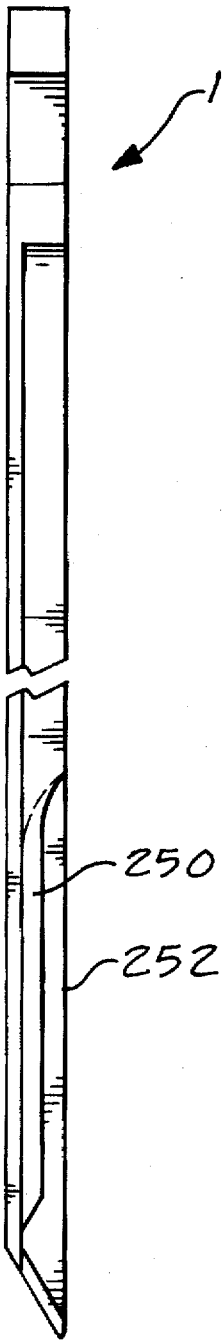
FIG. 15 is a side elevation view of a vent bar formed in accordance with the present invention.
Figure 16:
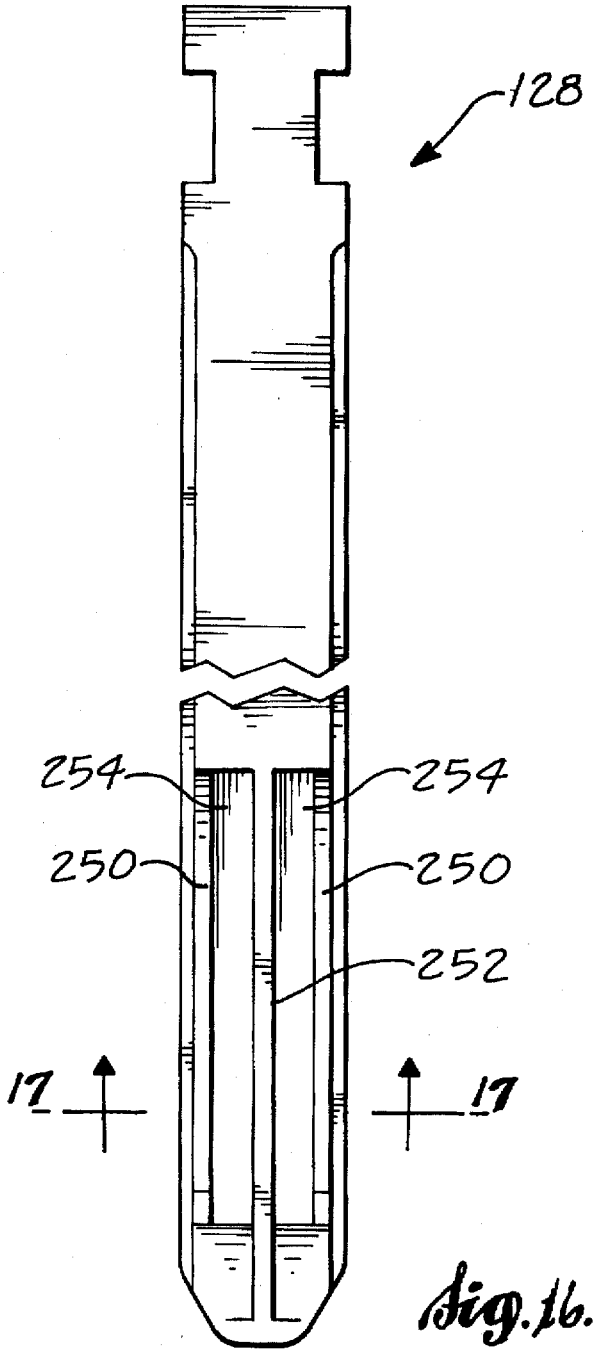
FIG. 16 is a front elevation of the vent bar of FIG. 15.
Figure 17:
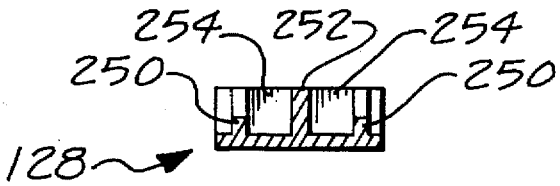
FIG. 17 is a cross section view of the vent bar of FIG. 15 along line 17—17.

Referring additionally to FIGS. 15, 16 and 17, vent bar 128 is an elongate member having an upper end wherein the left and right edges are notched to mate with vent bar mount 216. In the illustrated embodiment, vent bar 128 is approximately 13 inches long, about 1.125 inches wide, and about 0.3 inches thick. The lower end of vent bar 128 is angled at approximately 30° away from the center of the containers and measuring chambers that it is to enter. The lower two-thirds of vent bar 128 comprises a thinner plate, approximately 0.0625 inches thick, with a number of ridges running parallel to the length of the vent bar that serve to define passageways or channels within the lower portion. Slightly inset from the left-most and right-most edge of the lower portion of vent bar 128 are intermediate ridges 250 that are approximately 0.125 inches above the surface of vent bar 128. These ridges are approximately 0.0625 inches thick. Positioned centrally between these two ridges is a major ridge 252 that is approximately 0.25 inches high and about 0.0625 inches wide. These ridges serve to define two channels 254 therebetween, which serve as passageways for gas to escape the container when the filler material is introduced therein. The vent bar can be machined from corrosion-resistant metals, such as stainless steel.

Referring to FIG. 1 and FIG. 7, after filler material has been introduced into measuring chambers 39 in measuring subsystem 14 and measuring chambers have been transferred by transfer subsystem 16 to a measuring chamber plate (122 in FIG. 2) a means is provided to prevent the premature loss of filler material from measuring chamber 39. In order to maintain the filler material in measuring chamber 39, a support plate 268 beneath measuring chambers 39 is provided for at least a portion of the path that the measuring chamber 39 follows around primary axis 102. In FIG. 7, the measuring chamber 39, container 114, plunger 126, vent bar 128, and support plate 268 are shown in isolation for clarity. Support plate 268 is a curved thin plate having an initial section that has a width that is slightly wider than the bottom edge of measuring chamber 39. A section of support plate 268 downstream (to the right) from the initial section includes a narrow cut-out along its inner periphery to allow for the passage of vent bar 128 below support plate 268 as described below in more detail. Support plate 268 has a curvature that is substantially identical to the path that measuring chambers 39 and containers 114 follow around primary axis 102. The portion of support plate 268 having a narrower width than the initial portion begins at an angular position of approximately 79°. Support plate 268 is positioned around ring 104 beginning at the angular position of approximately 0°. Support plate 268 extends beneath measuring chambers 39 along their path until the angular position of approximately 138° is reached. The angular position where support plate 268 terminates corresponds to the angular position where plunger 126 begins to displace filler material from measuring chamber 39 into underlying container 114. The trailing end of support plate 268 includes a semicircular cutout that has a diameter substantially equal to the diameter of the interior of measuring chamber 39. A more detailed description of the cooperation of support plate 268, plungers 126 and vent bars 128 is provided below in conjunction with FIGS. 8–13.

Figure 5:
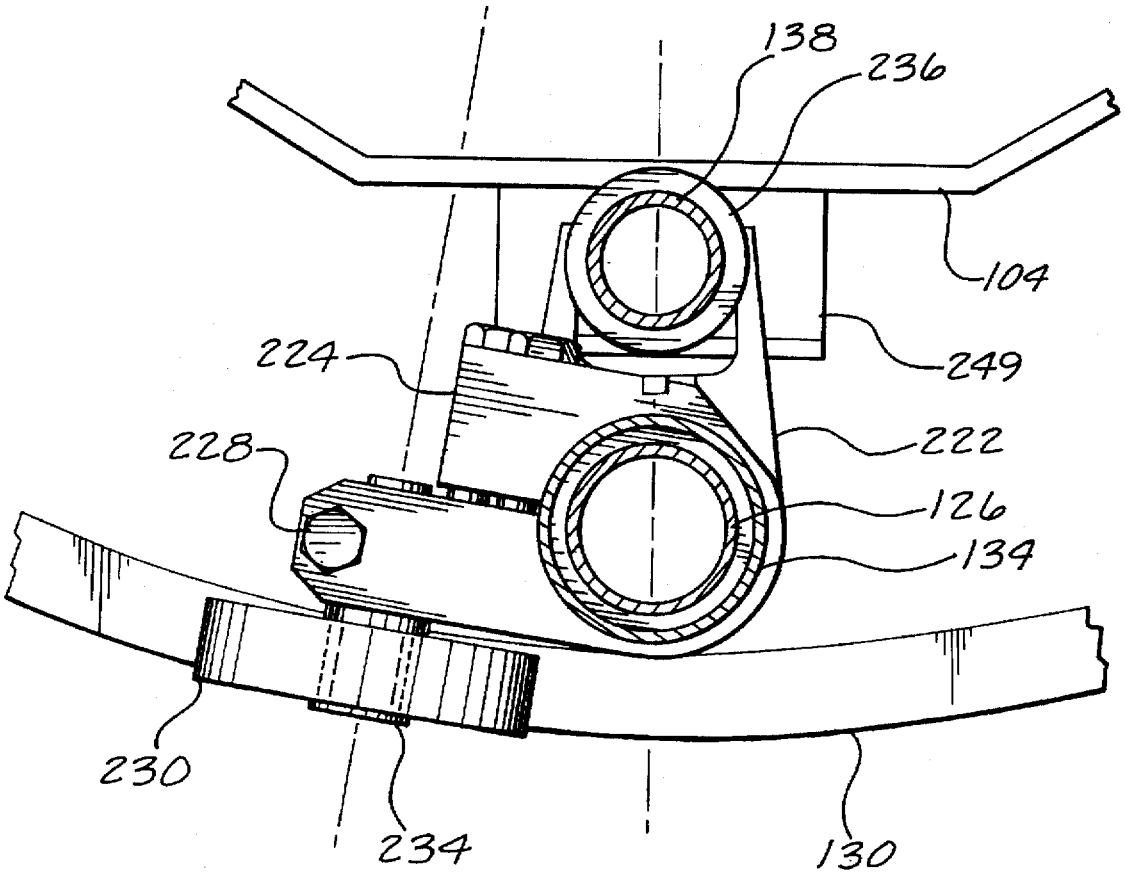
FIG. 5 is a horizontal section view of the plunger system and track of FIG. 2 along line 5—5.

Referring to FIGS. 1 and 5, rollers 230 and 232 lead plunger housing 134 and plunger 126 by an angular distance of 10°. Since track 130 has a smooth undulation, as rollers 230 and 232 follow track 130, they vertically displace plunger housing 134 with respect to the horizontal planes in which measuring chambers 39 and containers 114 are located. This vertical displacement is transferred to vent bar 128 through vent bar assembly 198. Likewise, piston 170 within plunger 126 is also displaced vertically as the rollers follow track 130. This movement causes the plunger and venting systems to discharge filler material from measuring chamber 39 into containers 114 and vent gas from containers 114, as described below in more detail. Since the vent bar 128 must be in the container 114 prior to filler material being introduced, the vertical displacement of the vent bar into the container must precede the introduction of the filler material. Accordingly, as described below in more detail, the ability of plunger 126 to reciprocate vertically relative to plunger housing 134, and the fact that spring 166 will absorb some of the vertical displacement of plunger housing 134 if the downward movement of plunger 126 is somehow restricted, vent bar 128 is able to enter container 114 prior to the introduction of filler material. In addition to enabling vent bar 128 to enter the container prior to the filler material, the cooperation between plunger housing 134 and plunger 126 through piston 170 allows plunger 126 to absorb a portion of the vertical displacement of the plunger housing 134. If plunger 126 were unable to absorb such vertical displacement, it would have the same stroke length and timing as vent bar 128 and accordingly, it would pass down to substantially the bottom of container 114, which would either result in undesirable compression and smashing of filler material or jamming of the filler apparatus.

The ability of the plunger system 100 to absorb a certain amount of the vertical displacement of plunger tracking assembly 132 can be understood with reference to FIGS. 1–4. Because plunger tracking assembly 132 is connected directly to plunger housing 134, there is a one-to-one correspondence of vertical displacement between plunger tracking system 132 and housing 134. In contrast, plunger 126 can reciprocate vertically independent of plunger housing 134 subject to the constraints of the top of piston 170 contacting bumper 174 or the compression of spring 166 by piston 170 reaching its maximum. When there is no resistance to the downward motion of plunger 126, the underside of bumper 174 rests on the top of piston 170, thus causing plunger 126 and plunger housing 134 to reciprocate in unison. As plunger tracking assembly 132 rotates to lower portions of track 130, plunger 126 descends downward with plunger housing 134 until the filler material in a measuring chamber 39 provides resistance to the downward motion of plunger 126. Although the filler material stops the downward movement of plunger 126, plunger tracking system 132, plunger housing 134, piston 170, and vent bar 128 continue to move downward. The continued downward movement of plunger tracking assembly 132, and thus piston 170, compresses spring 166 until the resistance to the downward movement of plunger 126 is removed by clearing the trailing end of support plate 268. This occurs at the angular position of about 138° in the illustrated embodiment.

After the trailing end of support plate 268 is passed, the potential energy of spring 166 is released and the lower end of plunger 126 is forced downward through measuring chamber 39 and displaces the filler material therefrom into underlying container 114. Prior to the discharge of filler material from measuring chamber 39 into container 114, vent bar 128 has already moved downward through measuring chamber 39 adjacent its inner periphery and into container 114 along its inner periphery. Vent bar 128 forms an indentation in the pocket of filler material while it is in measuring chamber 39 and maintains the indentation as the filler material is introduced into container 114. As plunger tracking system 132 approaches the bottom of the undulation of track 130, it begins to move upward, causing plunger housing 134 to rise, which carries vent bar 128. This upward movement does not result in a consequent upward movement of plunger 126 until piston 170 has released the tension in spring 166 and come into contact with the underside of bumper 174. Accordingly, as the vent bar 128 begins to remove itself from container 114, plunger 126 continues to maintain pressure on the filler material in the container, and thus compresses the filler material such that the indentation created by the vent bar 128 is dissipated. At the point where the upper surface of piston 170 contacts the underside of bumper 174, plunger housing 134 picks up plunger 126 and they both reciprocate vertically in unison. The presence of vent bar 128 with its channels 254 provides an escape for gas present in container 114 beneath the filler material. By allowing the gas to escape, the build-up of pressure beneath the filler material within container 114 is avoided. Accordingly, there is little risk that the filler material will pop back out of the container 114.

Figure 6:
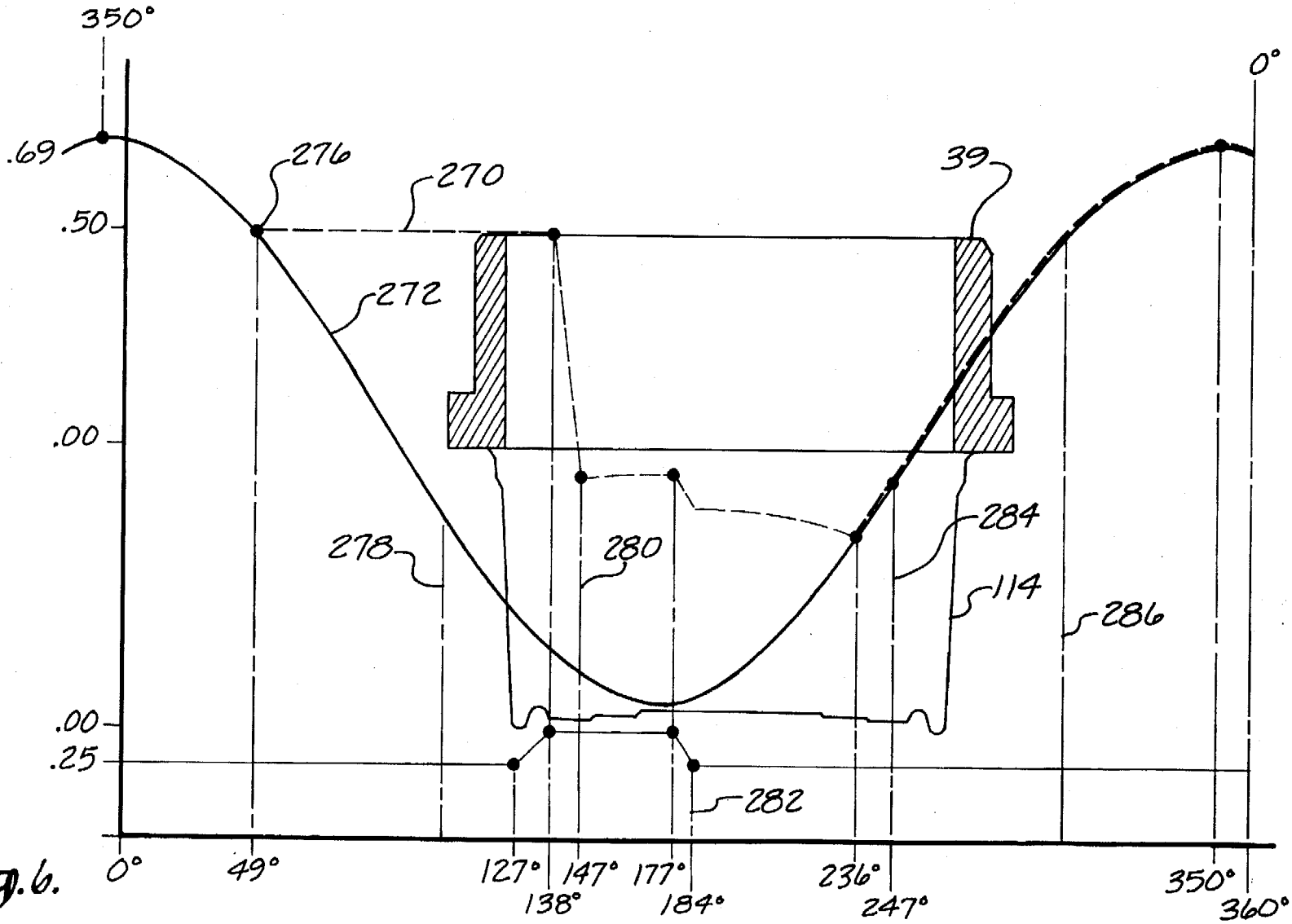
FIG. 6 is a graphical representation of the relative position of the bottom of the plunger and the bottom of the vent bar at various angular locations around the primary axis.

Referring to FIG. 6, a graphical depiction of the relative position of the bottom of plunger 126 and the bottom of vent bar 128 relative to the angular position of plunger 126, plunger housing 134 and vent bar 128 around ring 104 and relative to measuring chamber 39 and container 114 is illustrated. In FIG. 6 the line identified by reference number 270 corresponds to the position of plunger 126 when filler material is present within measuring chamber 39. The line identified by reference number 272 corresponds to the position of vent bar 128 and would represent the position of plunger 126 if filler material were not present in measuring chamber 39. The positions in the graph of FIG. 6 corresponding to the schematic depiction of FIGS. 8–13 are identified by reference numbers 276, 278, 280, 282, 284, and 286, respectively.

Figure 10:
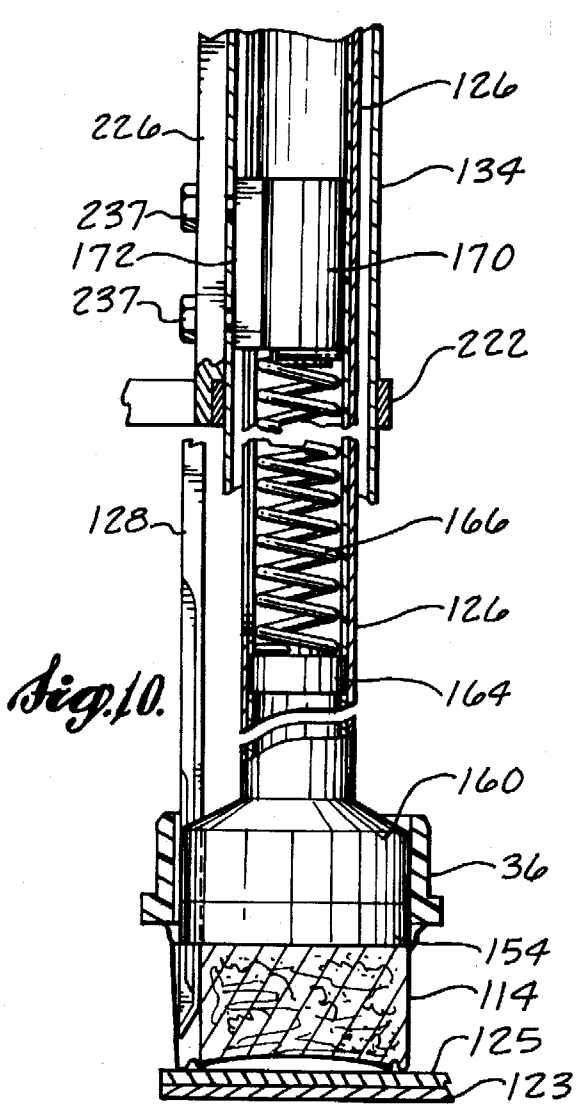
FIGS. 8–13 are horizontal section views of the plunger system and venting system as they revolve around the primary axis and filler material is introduced from the measuring chamber into the container.
Figure 9:
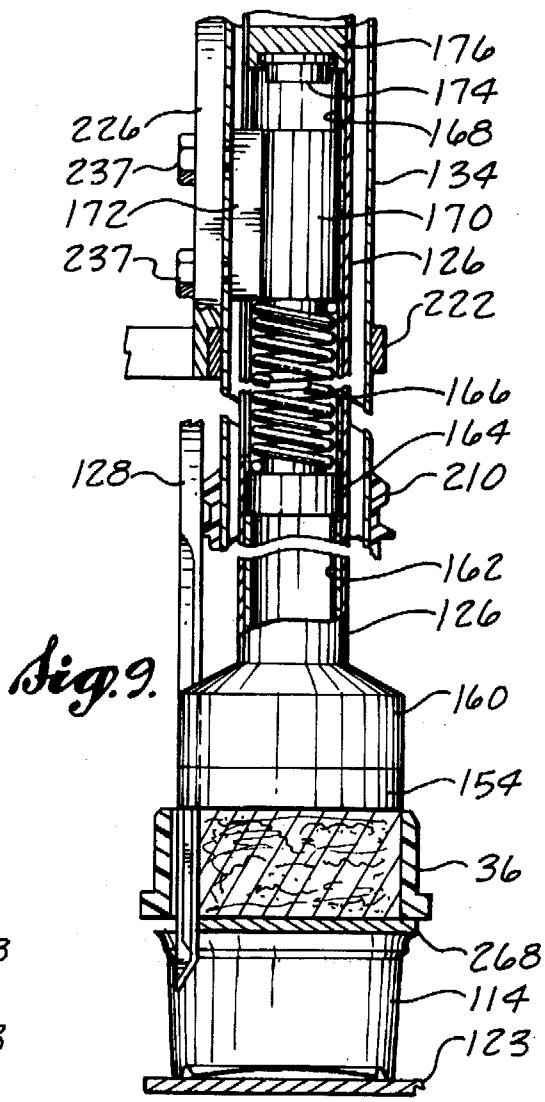
Figure 8:
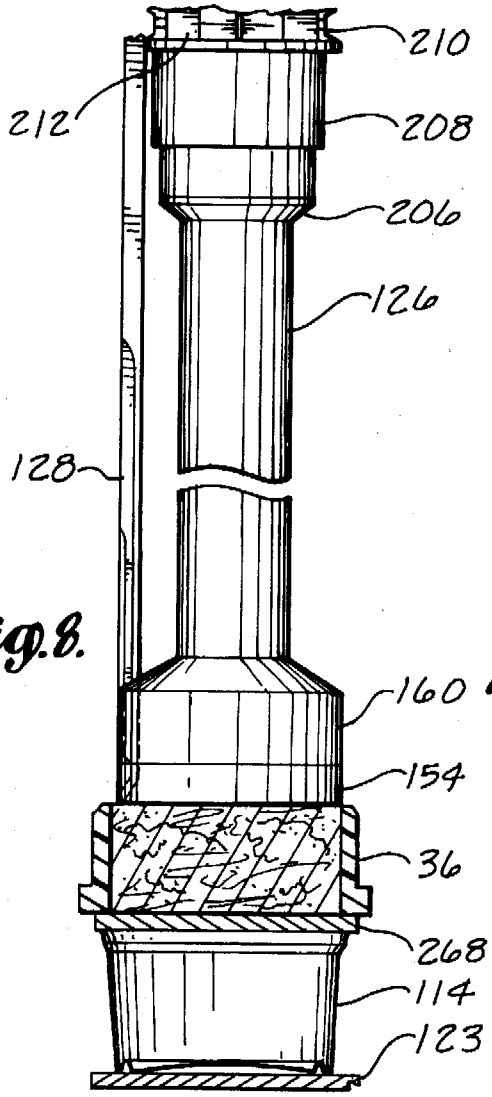
Figure 13:
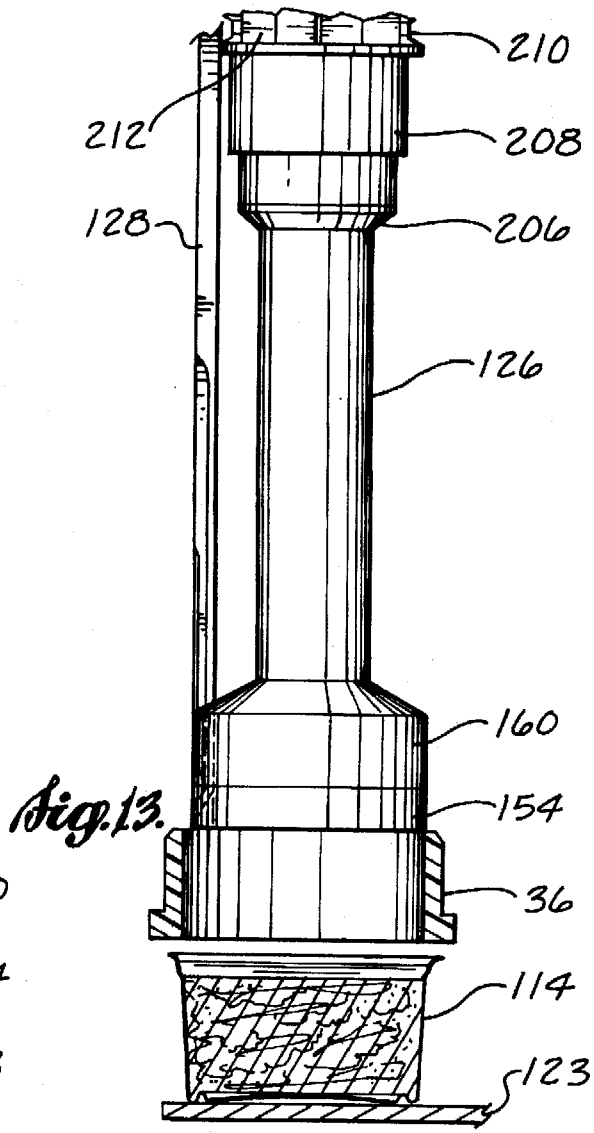

Referring specifically to FIG. 8, measuring chamber 39 is full of filler material and container 114 is positioned below measuring chamber 39. The relative angular position of the plunger and venting system depicted is about 49°. This is the position where vent bar 128 begins to enter measuring chamber 39 and plunger pad 154 contacts the upper surface of the filler material. As can be seen in FIG. 8, support plate 268 is positioned below measuring chamber 39 and prevents filler material from prematurely escaping the measuring chamber. Referring to FIG. 9 (bearing latch 214 and vent bar mount 216 have been omitted from FIGS. 9–12 for purposes of illustration), as the plunger and venting systems proceed to an angular position past about 81°, vent bar 128 has moved downward through filler material in measuring chamber 39, past support plate 268, and into container 114. At this position, plunger pad 154 maintains contact with the upper surface of filler material in measuring chamber 39 and the downward movement of plunger tracking assembly 132 has caused piston 170 to compress spring 166 against lower spring stop 146. Referring to FIG. 10 the angular position of about 138° is illustrated. At this location, the end of support plate 268 has been cleared and accordingly, a portion of the potential energy stored by compressed spring 166 is released causing plunger 126 to extend forcefully downward and drive filler material from measuring chamber 39 into container 114. Prior to clearing the end of support plate 268, container 114 reaches the riser plate 125 and is raised to close the gap between the underside of measuring chamber 39 and the upper lip of container 114 previously occupied by support plate 268. By closing this gap, leakage of filler material therethrough is reduced. As described above, as vent bar 128 passes through the filler material in measuring chamber 39, it creates an indentation in the filler material. Vent bar 128 is able to maintain this indentation in the filler material as it is dispensed into the container 114 because vent bar 128 precedes the filler material into filler container 114. This indentation, along with the channels provided in the body of vent bar 128, provide the passageway needed to allow gas to escape from beneath the filler material. As the rotation of plunger 126 and venting system 108 continues to about the 170° angular position, the downward displacement of plunger housing 134 and piston 170 reintroduces the compression into spring 166 that was released when filler material was displaced into container 114. At about the 170° angular position, the low point of track 130 is being passed by rollers 230 and 232, and thus plunger tracking assembly 132 begins to reciprocate upward in the opposite direction.

Figure 12:
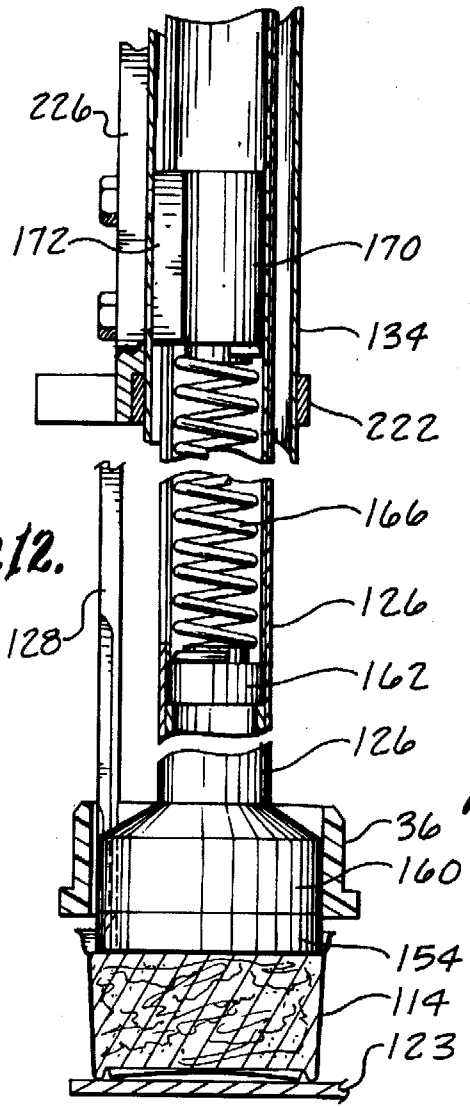
Figure 11:
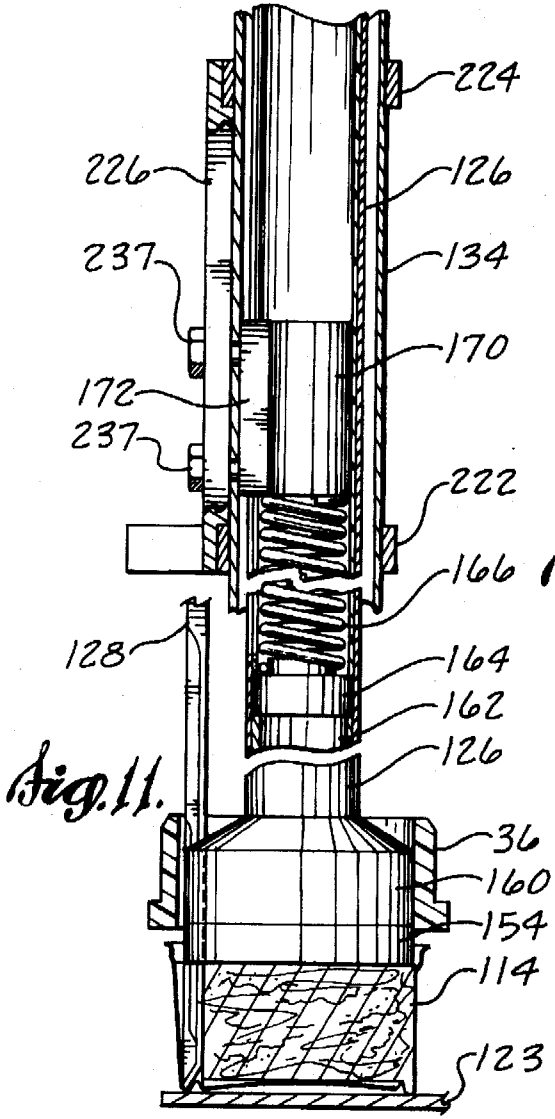

Accordingly, vent bar 128 begins to reverse its direction and reciprocate upward out of container 114. At the angular position of about 177°, the trailing end of riser plate 125 is reached, and the container 114 is lowered onto the surface of container plate 123. This lowering of container 114 and the filler material contained therein is indicated by the downward jog in dotted line 270 at about 177°. From the angular position 184°, the vertical position of plunger pad 154 slowly proceeds downward because vent bar 128 is being removed from the filler material, and the indentation left by vent bar 128 is being dissipated by the compressive force of plunger pad 154. This sequence of events is illustrated in FIGS. 11 and 12. In FIG. 12, vent bar 128 has about fully removed itself from the container at an angular position past 247°. The plunger pad 154 and vent bar 128 then reciprocate upward in unison because the upper side of piston 170 has come into contact with the underside of bumper 174, and plunger housing 134 and plunger 126 will move in unison, as described above. Subsequent to the position depicted in FIG. 13 container 114 is removed from beneath measuring chamber 39 and measuring chamber 39 is returned to measuring subsystem 14 in FIG. 1 for refilling.

Figure 14:
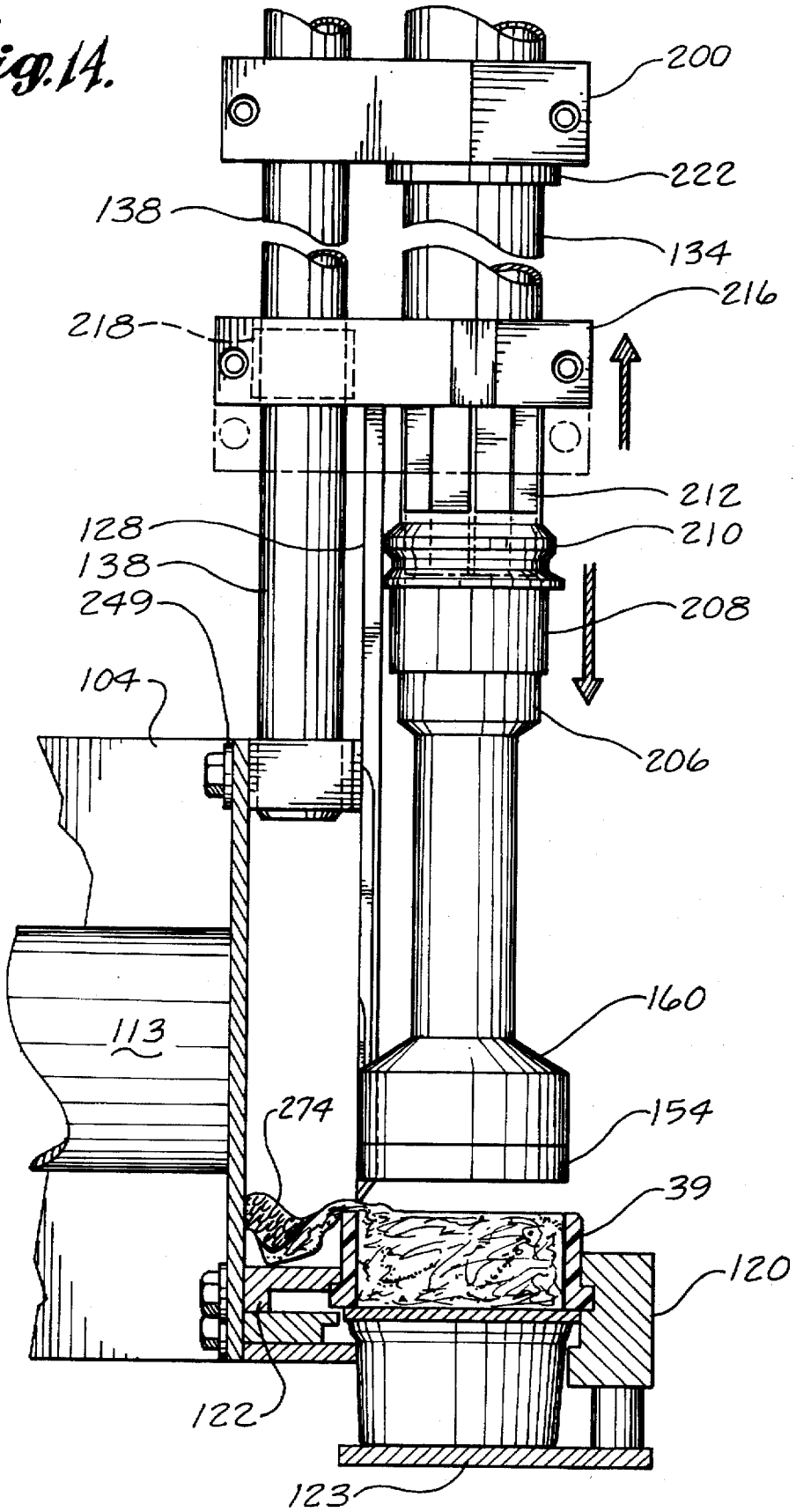
FIG. 14 is a front elevation view of a plunger and venting system formed in accordance with the present invention wherein the venting system has been released from the plunger system.

Referring to FIGS. 1 and 14, plunger system 100 and venting system 108 formed in accordance with the present invention includes a safety mechanism to prevent damage to the equipment when the filler material or some other obstruction restricts the downward movement of plunger 126. Referring specifically to FIG. 14, a piece of skin or bone, indicated by reference numeral 274 of a salmon, is overlying the upper edge of measuring chamber 39, thus blocking the downward movement of vent bar 128. If the obstruction is relatively soft or pliable and can be cut through or broken by plunger pad 154, reliance can be made on biasing assembly 144 described above to cooperate with a cam 276 (in FIG. 1) supported above top ring 246 by a spring-loaded piston 278 attached to the trailing end of cam 276 and support arm 277 attached to the leading edge of cam 276. The connection between support arm 277 and cam 276 is such that the cam can pivot up or down relative to the top of the support arm. Cam 276 lies in the path of biasing rollers 188 above the elevation that such rollers would normally occupy if filling of containers is proceeding normally. Cam 276 includes an arcuate underside that has a trailing edge that extends downward toward top ring 246. If the downward movement of plunger housing 134 is restricted by an obstruction in the path of plunger pad 154, biasing roller 188 will be at an elevation such that it contacts the underside of cam 276 and the trailing edge thereof exerts a downward force on plunger 126, encouraging plunger 126 to cut through or otherwise break through the obstruction blocking plunger pad 154. If the obstruction is such that the pressure exerted by cam 276 on biasing roller 188 is not sufficient to cause plunger pad 154 to break through the obstruction, then spring-loaded piston 278 releases and the cam 276 pivots on support arm 277 and moves up to prevent damage. In a preferred embodiment, the spring-loaded piston 278 has a release pressure of approximately 175 pounds, although lower or greater release pressures may be used. A typical situation where the downward movement of the plunger pad is obstructed occurs when container 114 cannot be properly vented and the air pressure that builds up underneath the filler material resists the downward movement of the plunger. In this situation, the cooperation between biasing roller 188 and cam 276 forces the plunger pad into the can and liquefies the fish, thus cleaning the can out and allowing the system to proceed further.

Continuing to refer to FIG. 14, in the situation where the obstruction blocking the downward movement of vent bar 128 is such that it cannot be broken through or removed, the continuous downward force exerted upon plunger housing 134 by plunger tracking assembly 132 will ultimately cause bearing fingers 212 to release seat 210 on strike 208 to prevent damage, such as bending, to vent bar 128.

Those skilled in the art will recognize that the embodiments of the invention disclosed herein are exemplary in nature and that various changes can be made therein without departing from the scope and the spirit of the invention. In this regard, deviations from the dimensions and the types of materials described above can be made without departing from the scope and spirit of the invention. Furthermore, the exact construction of the various elements can be varied as desired and still take advantage of the principles of the present invention. Because of the above and numerous other variations and modifications that can occur to those skilled in the art, the following claims should not be limited to the embodiments illustrated and discussed herein.

The embodiments of the invention in which an exclusive property or privilege is claimed are defined as follows:

1. A system for displacing filler material from measuring chambers into containers, wherein each measuring chamber revolves substantially in unison with a container around a primary axis, said measuring chamber being positioned above said container along a second axis different from the primary axis, said measuring chamber and said container being carried by a frame that rotates around said primary axis, the system comprising:

a generally circular track centered on the primary axis, said track lying in a nonhorizonial plane;

a plunger tracking assembly for following said track;

a plunger assembly adapted to be carried by said frame and coupled to said plunger tracking assembly, said plunger assembly including a plunger carrying a spring for absorbing vertical displacement of said plunger tracking assembly relative to the plunger as said plunger tracking assembly follows said track;

a vent bar having an upper end and a lower end, the lower end including a passageway for allowing gas trapped in the container below the filler material to escape; and a vent bar mount for connecting the upper end of said vent bar to said plunger assembly vertical displacement of said plunger housing being transferred to said vent bar by said vent bar mount.

2. The system of claim 1, wherein a footprint of said track projected onto a horizontal plane is round.

3. The system of claim 1, wherein said plunger tracking assembly includes an upper roller for following an upper surface of said track and a lower roller for following a lower surface of said track.

4. The system of claim 3, wherein said upper roller and said lower roller precede said plunger housing by 10 degrees around said track.

5. The system of claim 1, wherein said plunger assembly includes a plunger housing located along the second axis and coupled to said plunger tracking assembly, the plunger housing being displaced vertically as said plunger tracking assembly follows said track, the plunger being slidably mounted to the plunger housing for sliding vertically along said second axis to displace filler material from a measuring chamber into a container.

6. The system of claim 1, wherein said plunger further comprises a piston for compressing said spring.

7. The system of claim 1, further comprising a plate adapted to be positioned below the measuring chamber, said plate preventing the filler material from exiting the measuring chamber before said vent bar passes through the measuring chamber.

8. The system of claim 7, further comprising a riser plate carried by said plate for elevating said containers.

* * * * *

UNITED STATES PATENT AND TRADEMARK OFFICE

CERTIFICATE OF CORRECTION

PATENT NO. : 5,685,349
DATED : November 11, 1997
INVENTOR(S) : S. Mihail et al.

It is certified that error appears in the above-identified patent and that said Letters Patent is hereby corrected as shown below:

| | | |
|---|---|---|
| COL. 18 (Claim 1, | LINE 27 line 10) | "nonhorizonial" should read --nonhorizontal-- |
| COL. 18 (Claim 1, | LINE 39 line 22) | After "assembly" insert --,-- |

Signed and Sealed this

Fourteenth Day of April, 1998

*Attest:*

*Attesting Officer*

BRUCE LEHMAN

*Commissioner of Patents and Trademarks*